US008733797B2

(12) United States Patent
Heim

(10) Patent No.: US 8,733,797 B2
(45) Date of Patent: May 27, 2014

(54) SECURITY ELEMENT AND METHOD FOR THE PRODUCTION THEREOF

(75) Inventor: Manfred Heim, Bad Tolz (DE)

(73) Assignee: Giesecke & Devrient GmbH, Munich (DE)

( * ) Notice: Subject to any disclaimer, the term of this patent is extended or adjusted under 35 U.S.C. 154(b) by 181 days.

(21) Appl. No.: 12/808,733

(22) PCT Filed: Dec. 17, 2008

(86) PCT No.: PCT/EP2008/010742

§ 371 (c)(1),
(2), (4) Date: Jun. 17, 2010

(87) PCT Pub. No.: WO2009/080263

PCT Pub. Date: Jul. 2, 2009

(65) Prior Publication Data

US 2010/0308570 A1 Dec. 9, 2010

(30) Foreign Application Priority Data

Dec. 20, 2007 (DE) ..... 10 2007 061 828

(51) Int. Cl.
*B42D 15/00* (2006.01)
*B42D 15/10* (2006.01)

(52) U.S. Cl.
USPC ..... 283/72; 283/91

(58) Field of Classification Search
USPC ..... 283/67, 72
See application file for complete search history.

(56) References Cited

U.S. PATENT DOCUMENTS

| | | | | |
|---|---|---|---|---|
| 3,858,977 | A | 1/1975 | Baird et al. | |
| 4,659,112 | A * | 4/1987 | Reiner et al. | 283/90 |
| 5,331,443 | A | 7/1994 | Stanisci | |
| 6,024,455 | A * | 2/2000 | O'Neill et al. | 359/530 |
| 6,761,959 | B1 | 7/2004 | Bonkowski et al. | |
| 6,987,590 | B2 | 1/2006 | Phillips et al. | |
| 7,029,745 | B2 | 4/2006 | Bonkowski et al. | |
| 7,667,894 | B2 | 2/2010 | Hoffmuller | |
| 7,728,931 | B2 | 6/2010 | Hoffmuller | |

(Continued)

FOREIGN PATENT DOCUMENTS

| | | |
|---|---|---|
| CN | 1976816 A | 6/2007 |
| DE | 102004039355 A1 | 2/2006 |

(Continued)

OTHER PUBLICATIONS

International Search Report, International Application No. PCT/EP2008/010742, 2 pages, Jul. 10, 2009.

(Continued)

*Primary Examiner* — Kyle Grabowski
(74) *Attorney, Agent, or Firm* — Lathrop & Gage LLP

(57) ABSTRACT

The invention relates to a security element (12) for securing value objects, with a thin film element (22) with color shift effect; a semitransparent ink layer (34), which is disposed on top of the thin film element (22) in first zones (30), wherein the color impression of the thin film element (22) is coordinated with the color impression of at least one subzone of the semitransparent ink layer (34) when viewed under predefined viewing conditions; and a transparent phase delay layer (36), which is disposed on top of the thin film element (22) in second zones, and which forms a phase-shifting layer for light in the visible wavelength range.

30 Claims, 4 Drawing Sheets

(56) References Cited

U.S. PATENT DOCUMENTS

Figure 1:
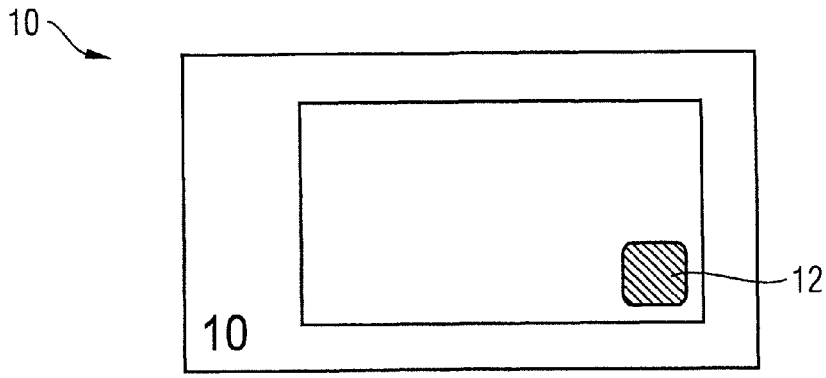

| | | | | |
|---|---|---|---|---|
| 7,808,605 | B2 | 10/2010 | Hoffmuller | |
| 7,986,459 | B2 | 7/2011 | Kaule | |
| 8,083,894 | B2 | 12/2011 | Gruszczynski | |
| 8,149,511 | B2 | 4/2012 | Kaule | |
| 2005/0128543 | A1 | 6/2005 | Phillips et al. | |
| 2005/0141094 | A1 | 6/2005 | Wild et al. | |
| 2005/0168723 | A1 | 8/2005 | Schilling et al. | |
| 2006/0077496 | A1 | 4/2006 | Argoitia et al. | |
| 2007/0165182 | A1 | 7/2007 | Hoffmuller | |
| 2007/0211238 | A1* | 9/2007 | Hoffmuller et al. | 283/72 |
| 2007/0216518 | A1 | 9/2007 | Hoffmuller | |
| 2007/0229928 | A1 | 10/2007 | Hoffmuller | |
| 2007/0241553 | A1* | 10/2007 | Heim et al. | 283/72 |
| 2007/0246933 | A1* | 10/2007 | Heim et al. | 283/98 |
| 2007/0273142 | A1 | 11/2007 | Tompkin et al. | |
| 2007/0274559 | A1 | 11/2007 | Depta | |
| 2008/0014378 | A1 | 1/2008 | Hoffmuller | |
| 2008/0054621 | A1 | 3/2008 | Burchard | |
| 2008/0079257 | A1 | 4/2008 | Fessl | |
| 2008/0088859 | A1 | 4/2008 | Depta | |
| 2008/0160226 | A1 | 7/2008 | Kaule | |
| 2008/0163994 | A1 | 7/2008 | Hoppe | |
| 2008/0198468 | A1 | 8/2008 | Kaule | |
| 2008/0216976 | A1 | 9/2008 | Ruck | |
| 2008/0250954 | A1 | 10/2008 | Depta | |
| 2008/0258456 | A1 | 10/2008 | Rahm | |
| 2009/0001709 | A1 | 1/2009 | Kretschmar | |
| 2009/0008923 | A1 | 1/2009 | Kaule | |
| 2009/0008926 | A1 | 1/2009 | Depta | |
| 2009/0102605 | A1 | 4/2009 | Kaule | |
| 2009/0115185 | A1 | 5/2009 | Hoffmuller | |
| 2009/0236061 | A1 | 9/2009 | Gruszczynski | |
| 2009/0297805 | A1 | 12/2009 | Dichtl | |
| 2009/0322071 | A1 | 12/2009 | Dichtl | |
| 2010/0175843 | A1 | 7/2010 | Gregarek | |
| 2010/0177094 | A1 | 7/2010 | Kaule | |
| 2010/0182221 | A1 | 7/2010 | Kaule | |
| 2010/0194091 | A1 | 8/2010 | Heim | |
| 2010/0194532 | A1 | 8/2010 | Kaule | |
| 2010/0196587 | A1 | 8/2010 | Keller | |
| 2010/0207376 | A1 | 8/2010 | Heim | |
| 2010/0208036 | A1 | 8/2010 | Kaule | |
| 2010/0307705 | A1 | 12/2010 | Rahm | |
| 2010/0308570 | A1 | 12/2010 | Heim | |
| 2010/0320742 | A1 | 12/2010 | Hoffmuller | |
| 2011/0007374 | A1 | 1/2011 | Heim | |
| 2011/0012337 | A1 | 1/2011 | Heim | |
| 2011/0027538 | A1 | 2/2011 | Hoffmann | |
| 2011/0045248 | A1 | 2/2011 | Hoffmuller | |
| 2011/0069360 | A1 | 3/2011 | Dichtl | |
| 2011/0079997 | A1 | 4/2011 | Heim | |
| 2011/0091665 | A1 | 4/2011 | Heim | |
| 2011/0095518 | A1 | 4/2011 | Hoffmuller | |
| 2011/0101670 | A1 | 5/2011 | Heim | |
| 2011/0109078 | A1 | 5/2011 | Hoffmuller | |
| 2011/0114733 | A1 | 5/2011 | Heim | |
| 2011/0157183 | A1 | 6/2011 | Kaule | |
| 2012/0126525 | A1 | 5/2012 | Dorfler | |
| 2012/0168515 | A1 | 7/2012 | Schutzmann | |
| 2012/0170124 | A1 | 7/2012 | Fuhse | |

FOREIGN PATENT DOCUMENTS

| | | | |
|---|---|---|---|
| DE | 102004051919 | A1 | 4/2006 |
| DE | 102006015023 | A1 | 10/2007 |
| EP | 1 003 126 | A2 | 5/2000 |
| EP | 1 203 968 | A1 | 5/2002 |
| EP | 1 047 549 | B1 | 3/2003 |
| EP | 0 733 919 | B1 | 9/2003 |
| EP | 0 911 758 | B1 | 11/2005 |
| EP | 1 628 147 | A1 | 2/2006 |
| EP | 1 715 392 | A1 | 10/2006 |
| EP | 1 503 907 | B1 | 1/2007 |
| JP | 2003326876 | A | 11/2003 |
| JP | 2008083599 | A | 4/2008 |
| WO | WO 01/03945 | A1 | 1/2001 |
| WO | WO 01/53113 | A1 | 7/2001 |
| WO | WO 02/00445 | A1 | 1/2002 |
| WO | WO 02/00446 | A1 | 1/2002 |
| WO | WO 03/095228 | A1 | 11/2003 |
| WO | WO 03/095657 | A2 | 11/2003 |
| WO | WO 2005/038136 | A1 | 4/2005 |
| WO | WO 2005/105474 | A2 | 11/2005 |
| WO | WO 2005/105475 | A1 | 11/2005 |
| WO | WO 2005/108108 | A2 | 11/2005 |
| WO | WO 2005105473 | | 11/2005 |
| WO | WO 2005105474 | | 11/2005 |
| WO | WO 2005105475 | | 11/2005 |
| WO | WO 2005108106 | | 11/2005 |
| WO | WO 2005108108 | | 11/2005 |
| WO | WO 2005108110 | | 11/2005 |
| WO | WO 2006005434 | | 1/2006 |
| WO | WO 2006015733 | | 2/2006 |
| WO | WO 2006018171 | | 2/2006 |
| WO | WO 2006018171 | A2 * | 2/2006 |
| WO | WO 2006018172 | | 2/2006 |
| WO | WO 2006/040069 | A1 | 4/2006 |
| WO | WO 2006040069 | | 4/2006 |
| WO | WO 2006040069 | A1 * | 4/2006 |
| WO | WO 2006056342 | | 6/2006 |
| WO | WO 2006072380 | | 7/2006 |
| WO | WO 2006087138 | | 8/2006 |
| WO | WO 2006099971 | | 9/2006 |
| WO | WO 2006119896 | | 11/2006 |
| WO | WO 2006128607 | | 12/2006 |
| WO | WO 2007006445 | | 1/2007 |
| WO | WO 2007006455 | | 1/2007 |
| WO | WO 2007/051529 | A1 | 5/2007 |
| WO | WO 2007076952 | | 7/2007 |
| WO | WO 2007079851 | | 7/2007 |
| WO | WO 2007115648 | | 10/2007 |
| WO | WO 2007/138293 | A2 | 12/2007 |
| WO | WO 2008/000350 | | 1/2008 |
| WO | WO 2008/000351 | | 1/2008 |
| WO | WO 2008/049533 | | 5/2008 |
| WO | WO 2008/061636 | | 5/2008 |
| WO | WO 2008/071325 | | 6/2008 |
| WO | WO 2009/000527 | | 12/2008 |
| WO | WO 2009/000528 | | 12/2008 |
| WO | WO 2009/000529 | | 12/2008 |
| WO | WO 2009/000530 | | 12/2008 |
| WO | WO 2009/012893 | | 1/2009 |
| WO | WO 2009/024265 | | 2/2009 |
| WO | WO 2009/080262 | | 7/2009 |
| WO | WO 2009/080263 | | 7/2009 |
| WO | WO 2009/083146 | | 7/2009 |
| WO | WO 2009/083151 | | 7/2009 |
| WO | WO 2009/100831 | | 8/2009 |
| WO | WO 2009/100869 | | 8/2009 |
| WO | WO 2009/109291 | | 9/2009 |
| WO | WO 2009/121578 | | 10/2009 |
| WO | WO 2009/149831 | | 12/2009 |
| WO | WO 2009/149833 | | 12/2009 |
| WO | WO 2009/156079 | | 12/2009 |
| WO | WO 2010/000470 | | 1/2010 |
| WO | WO 2010/003646 | | 1/2010 |
| WO | WO 2010/028739 | | 3/2010 |
| WO | WO 2011/012281 | | 2/2011 |
| WO | WO 2011/032665 | | 3/2011 |
| WO | WO 2011/032671 | | 3/2011 |

OTHER PUBLICATIONS

International Preliminary Report on Patentability, International Application No. PCT/EP2008/010742, 6 pages, Aug. 3, 2010, English Translation.

International Search Report, International Application No. PCT/EP2008/010740, 3 pages, Apr. 23, 2009.

International Preliminary Report on Patentability, International Application No. PCT/EP2008/010740, 6 pages, Nov. 22, 2010, English Translation.

International Search Report, International Application No. PCT/EP2009/000686, 2 pages, Sep. 18, 2009.

(56) References Cited

OTHER PUBLICATIONS

International Preliminary Report on Patentability, International Application No. PCT/EP2009/000686, 6 pages, Sep. 7, 2010, English Translation.

International Search Report, International Application No. PCT/EP2009/001094, 2 pages, Jul. 10, 2009.

International Preliminary Report on Patentability, International Application No. PCT/EP2009/001094, 9 pages, Nov. 2, 2010.

* cited by examiner

SECURITY ELEMENT AND METHOD FOR THE PRODUCTION THEREOF

CROSS-REFERENCE TO RELATED APPLICATIONS

This application is the U.S. National Stage of International Application No. PCT/EP2008/010742, filed Dec. 17, 2008, which claims the benefit of German Patent Application DE 10 2007 061 828.1, filed Dec. 20, 2007, both of which are hereby incorporated by reference to the extent not inconsistent with the disclosure herewith.

The invention relates to a security element for securing items of value, a method for manufacturing such a security element, and to a security paper and a data carrier having such a security element.

For protection, data carriers such as value or identity documents, but also other objects of value, such as branded articles, are often provided with security elements that enable the authenticity of the data carrier to be verified and at the same time serve as protection against illicit reproduction. Security elements of such kind may for example have the form of a security thread embedded in a banknote, a covering foil for a banknote having a hole, an applied security strip, a self-supporting transfer element, or it may even be designed as a feature area applied directly to a value document.

Security elements displaying visual effects that change according to the angle at which they are viewed, are particularly important for safeguarding against forgery, because these cannot be reproduced even with the most modern copiers. For this purpose, the security elements are provided with optically variable elements, which present the viewer with a different image impression, and for example a different color or brightness impression and/or motif when they are viewed from different angles.

In this context, it is known to use security elements having multilayer thin film elements, which present the viewer with a different color impression depending on the angle from which they are viewed, such that the security feature changes color for example from green to blue, from blue to magenta, or from magenta to green when it is tilted. These changes in color that take place when the security element is tilted are referred to in the following as the color shift effect.

Based on that, the object of the invention is to further improve a security element of the kind described in the introduction, and particularly to provide a security element with an attractive visual appearance and high counterfeit security.

This object is solved by the security element having the features of the main claim. A method for manufacturing such a security element, a security paper, and a data carrier are described in the coordinate claims. Developments of the invention are the subject of the dependent claims.

According to the invention, a security element of the type described in the introduction includes

- a thin film element having a color shift effect,
- a semitransparent ink layer, which is disposed on top of the thin film element in first zones, wherein the color impression of the thin film element is coordinated with at least one subzone of the semitransparent ink layer when viewed under predefined viewing conditions, and
- a transparent phase delay layer, which is disposed on top of the thin film element in second zones, and which forms a phase-shifting layer for light in the visible wavelength range.

In the context of the invention, a combination of various color zones is thus used that appear very similar when seen from a certain viewing direction, but which behave differently when the security element is tilted. In the color shifting zones that are not covered by the semitransparent ink layer, the color impression for the viewer changes when the security element is tilted, whereas the covered zones remain essentially color-constant. Such a combination of color-constant and color-variable zones has an attractive visual effect and is self-explanatory for the user, since the color-constant zones function as a visual reference and point of comparison with the color-variable zones during authentication. The combination of two color effects immediately adjacent one another makes it very difficult to recreate the security element, since freely available colors or foils with color shift effects can no longer be used without modification.

In addition to the overt security feature, i.e. the security feature detectable without auxiliary means, which is formed by the two different color zones, the security element according to the invention also includes a concealed security feature, which is only perceptible with auxiliary means, and which is formed by the transparent phase delay layer disposed in second zones. Phase-delaying layers, which are sometimes also referred to as phase-shifting layers within the scope of this description, are optically active layers that influence the phase of a transmitted light wave. As a result of the different refractive indices the partial light beams of an incident polarized light wave undergo optical retardation and thus receive a phase difference. If the phase difference between the two partial beams is just one half or one quarter of the wavelength, so called $\lambda/2$ or $\lambda/4$ layers are formed.

The phase delay of the phase delay layer in the invention preferably corresponds to an optical retardation between about $\lambda/6$ and about $\lambda/2$, particularly between about $\lambda/4$ and about $\lambda/2$. Thereby, the optical retardation is specified modulo $\lambda$, that is to say in the range between 0 and $\lambda$, because a layer with a phase retardation of, for example $5/4*\lambda$ or $9/4*\lambda$ causes the same phase delay as a $\lambda/4$ layer. Within the present invention, it is further preferred that the phase shifting layer is formed from nematic liquid crystal material and/or that the phase delay layer is provided in the form of patterns, characters or a code.

The semitransparent ink layer preferably has a light transmissivity between 30% and 95%, particularly preferably between 60% and 95%, and especially preferably between 80% and 95% in a spectral range in which the color impression of the thin film element is coordinated with the color impression of the semitransparent layer.

The semitransparent ink layer may be applied in various ways, advantageously it is imprinted, for example in a silk-screen, intaglio, flexographic, or other suitable printing process. In this context, the semitransparent ink layer may be printed directly onto the thin film element, though transparent intermediate layers may also be provided between the ink layer and the thin film element, functioning as a protective or adhesive layer, for example. Such transparent intermediate layers may also be provided between the ink layer and the phase delay layer.

In order to enable additional features to be introduced into the security element, in preferred embodiments the semitransparent ink layer is present in the form of characters, patterns or codes. This also includes configurations in which the ink layer is provided with gaps in the form of characters, patterns or codes.

In particularly preferred embodiments, the semitransparent ink layer is selected such that it essentially preserves the polarization state of penetrating light in the visible wavelength range. In this way, the patterns, characters or codes formed by the phase delay layer may be rendered equally visible both in the color-variable and the color-constant zones, as will be explained in greater detail below.

The semitransparent ink layer may also include multiple subzones with different color impressions, in which case the color impression of the thin film element when viewed under predefined viewing conditions is coordinated with the color impression of at least one of the subzones.

A particularly appealing effect may be achieved if the thin film element and the semitransparent ink layer are harmonized with each other in such way that when the security element is viewed perpendicularly the color impression of the thin film element outside the first zones essentially matches the color impression of at least one subzone of the semitransparent ink layer. When viewed perpendicularly, which is often the way a security element applied to a value item is seen initially, the color-variable and color-constant zones then convey essentially the same color impression at first glance. When the security element is tilted, the color impression in the color-variable zones changes, while the color impression in the color-constant, covered zones, remains unchanged.

In an advantageous embodiment of the invention, the thin film element is provided with a reflection layer, an absorber layer, and a dielectric spacer layer disposed between the reflection layer and the absorber layer. The color shift effect in such thin film elements is based on viewing angle dependent interference effects arising from multiple reflections on various sublayers of the element. The path difference of the light reflected at the various layers is determined on the one hand by the optical thickness of the dielectric spacer layer, which determines the distance between the absorber layer and the reflection layer, and it also varies according to the viewing angle.

Since the path difference is of the order of magnitude of the wavelength of visible light, the color impression varies for the viewer according to angle as certain wavelengths are cancelled and others amplified. By suitable selection of material and thickness of the dielectric spacer layer, it is possible to create a wide range of different color shift effects, for example tilt effects in which the color impression changes from green to blue, from blue to magenta, or from magenta to green depending on the viewing angle.

The reflection layer of the thin film element is preferably formed by an opaque or semitransparent metallic layer, particularly of aluminum. A layer of which at least partial areas are magnetic may also be used as the reflection layer, thus enabling a further authentication feature to be integrated without the need for an additional layer in the layer construction.

The reflection layer may include further gaps in the shape of patterns, characters or codes, which form transparent or semitransparent zones in the thin film element. The viewer perceives a marked contrast with the surrounding color effects in the transparent or semitransparent gap zones. In particular, the patterns, characters or codes may shine brightly in transmitted light when the thin film element is applied to a transparent or translucent substrate. The gaps in the reflection layer may also be arranged grid-like, preferably with a small area fraction of 40% or less, so that they are practically unnoticeable in reflected light, and only appear clearly in transmitted light.

According to another, also advantageous embodiment of the invention, the thin film element may also be formed by superposed absorber layers and dielectric spacer layers, wherein multiple absorber and spacer layers may also be arranged one on top of the other alternatingly. Thin film elements of such kind also present a color shift effect, but are not opaque, so the color shift effect is also visible from the rear of the security element.

In all configurations, the dielectric spacer layer is preferably created in a vacuum vapor deposition process. Alternatively, the spacer layer may also be formed by a printed layer or an ultrathin foil, particularly a stretched polyester foil. Currently, a construction in which the dielectric spacer layer is formed by a low refractive dielectric layer, particularly a vapor-deposited $SiO_2$ layer or an $MgF_2$ layer, is preferred.

Further details regarding the structure of such thin film elements and the materials and layer thicknesses that may be used for the reflection layer, the dielectric spacer layer and the absorber layer are included in patent specification WO 01/03945, the disclosure of which in this respect is included in the present application.

Alternatively or in addition to the gaps in the reflection layer, the absorber layer and/or the spacer layer may also have gaps in the form of patterns, characters or codes. A color shift effect does not occur in the gap zones of the absorber layer or the spacer layer.

In an advantageous improvement of the invention, the security element further includes a relief structure, above which the thin film element is disposed in an overlap area. In this context, the thin film element may be arranged over part or all of the relief structure, or it may also protrude beyond it.

The relief structure may form a diffractive structure, such as a hologram, a holographic grating image, a hologram-like diffraction structure, or also an achromatic structure such as a matte structure with an uncolored, typically silvery matt appearance, a micromirror arrangement, a blazed grating with a sawtooth-like notched profile or a Fresnel lens arrangement. The dimensions of the structural elements in the diffractive relief structures are mostly in the magnitude of light wavelength, that is to say typically between 300 nm and 1 μm. Some relief structures also include smaller structure elements such as subwavelength gratings or moth-eye structures, the structure elements of which may even be smaller than 100 nm. Some structure elements of achromatic relief structures are also larger than 1 μm, the dimensions of micromirrors or blazed grating lines may reach a height of about 15 μm and a lateral extension of about 30 μm.

In an advantageous configuration, the security element includes a substrate on which the thin film element, the semitransparent ink layer and the phase delay layer are arranged. Particularly, this substrate may be formed by a plastic foil. After the security element has been transferred to a data carrier, the substrate may be detached from the layer structure of the security element, or it may be left as a permanent component of the security element in the layer structure as a protective layer. In some configurations, a releasing or separating layer, for example a wax, may also be provided between the security element and the substrate.

The security element is preferably a security thread, a security tape, a security strip, a patch or a label for attachment to a security paper, value document or the like.

Of course, the security element may also include additional layers, such as protective layers or additional effect layers with different security features, for example.

The invention also relates to a method for manufacturing a security element of the type described, in which in first zones, a semitransparent ink layer is disposed on top of a thin film element having a color-shift effect, wherein the color impression of the thin film element is coordinated with the color impression of at least one subzone of the semitransparent ink layer when viewed under predefined viewing conditions, and a transparent phase delay layer is disposed on top of the thin film element in second zones, which forms a phase-shifting layers for light in the visible wavelength range.

In the method according to the invention, the semitransparent ink layer is advantageously imprinted, particularly in a silkscreen, intaglio or flexographic printing process. The phase delay layer may also be advantageously printed onto the thin film element and, if applicable, onto the ink layer which was applied beforehand. Alternatively, the phase delay layer may be applied to a separate carrier foil and transferred to the thin film element with the applied ink layer.

In an improvement of the method according to the invention, an embossing lacquer layer is applied to a substrate and is embossed in the form of a desired relief structure. A thin film element is then disposed on top of this relief structure in an overlap area in the manner described above.

In advantageous embodiments, the reflection layer and/or the absorber layer of the thin film element are provided with gaps in the form of patterns, characters, or codes.

The invention further includes a security paper having a security element of the type described, and a data carrier that is equipped with such a security element. The data carrier may particularly be a banknote, a value document, a passport, a certificate or an identity card. The security elements, security papers or data carriers described may particularly be used to protect objects of any kind against forgery.

Since the semitransparent ink layers described above largely preserve the polarization of the light passing through it, it is in general also possible to coat zones of a metallic layer with a semitransparent ink layer and to dispose a transparent phase delay layer in the form of patterns, characters or codes on top of it, and to render such patterns, characters and codes visible in the coated zones as well as in the uncoated zones when viewed with a suitable polarizer.

Further embodiments and advantages of the invention will be explained in the following with reference to the drawing, in which, for the sake of clarity, the elements are not drawn to a uniform scale or proportion.

Figure 2:
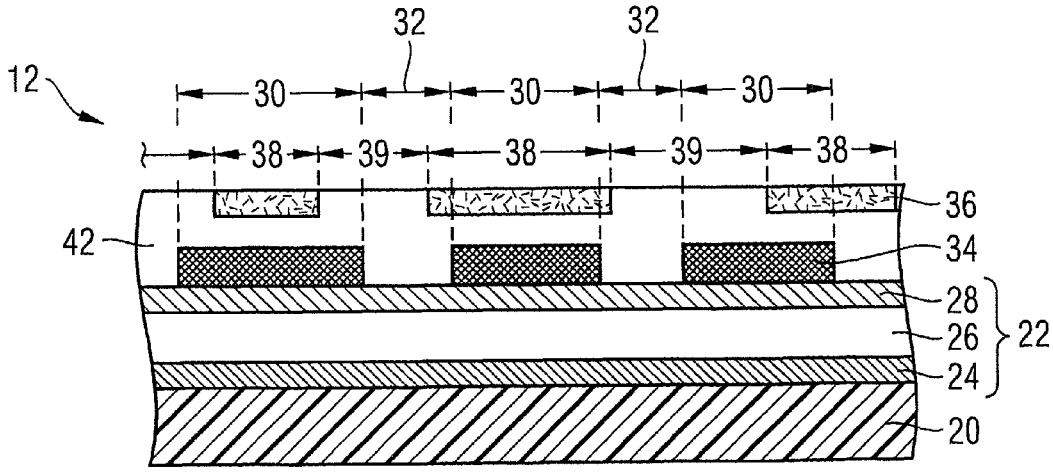
Figure 3A:
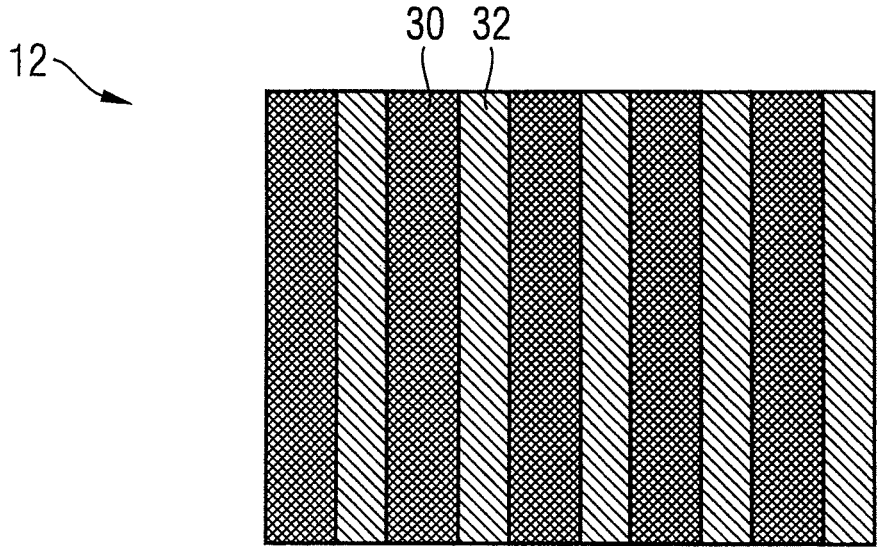
Figure 3B:
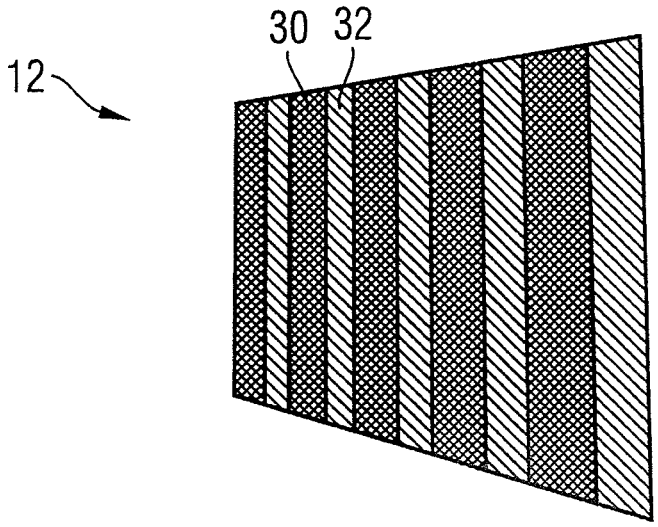
Figure 3C:
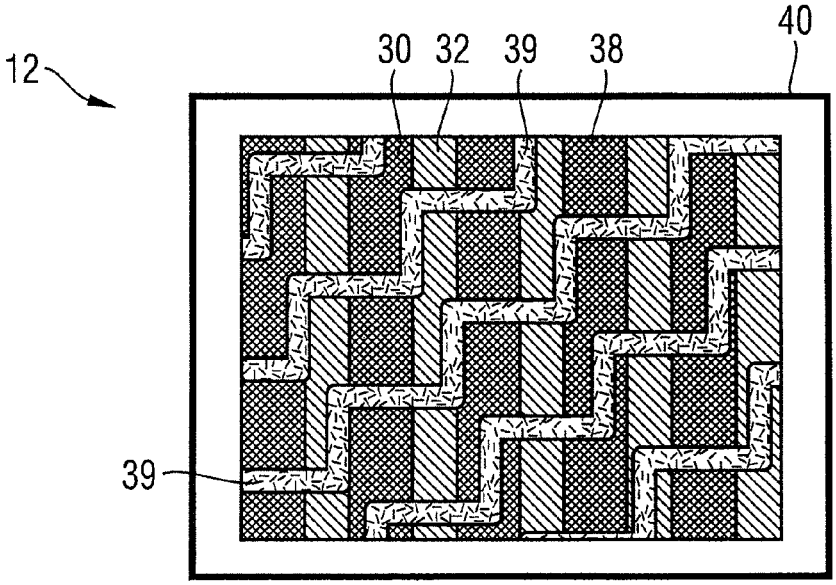
Figure 4:
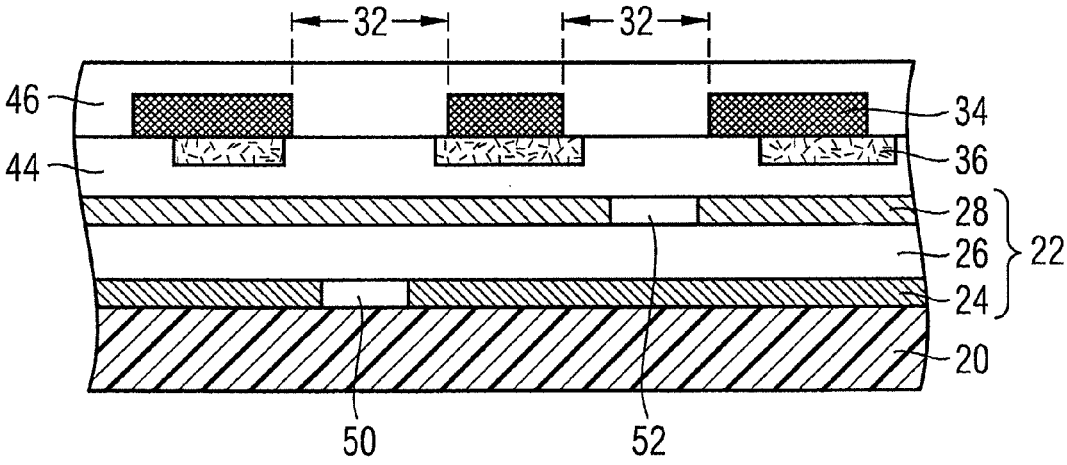
Figure 5:
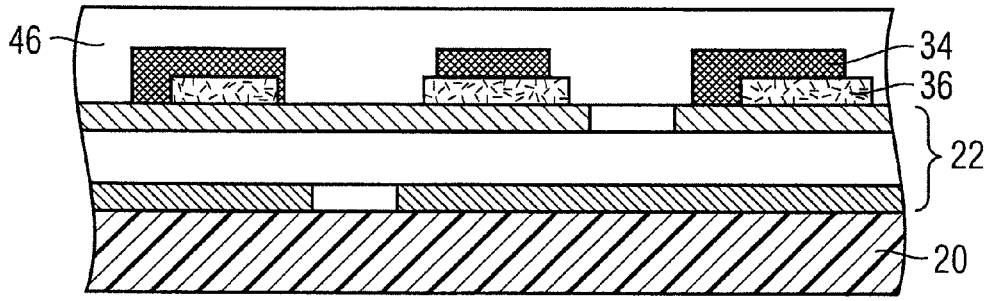
Figure 6:
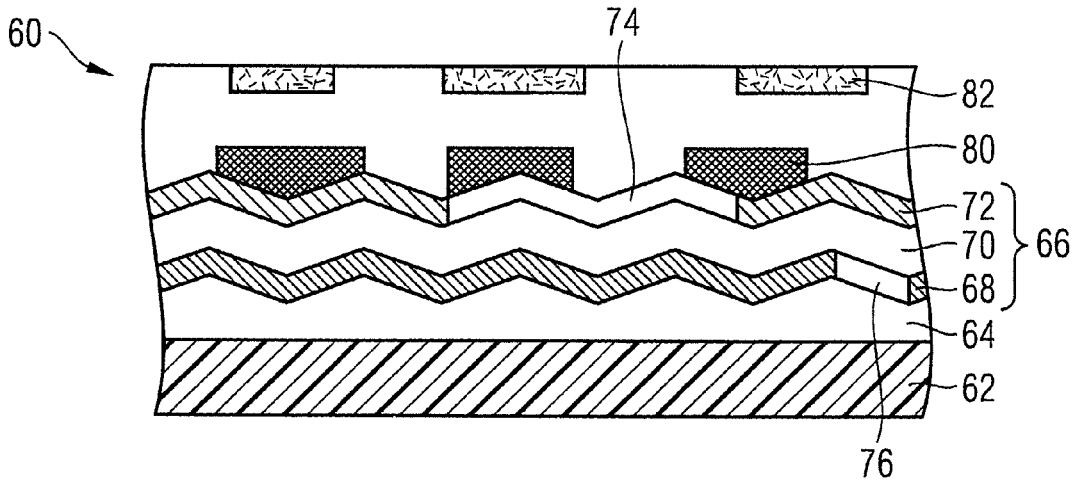

In the drawings:

FIG. 1 is a schematic representation of a banknote having a security element according to the invention, FIG. 2 is a cross section through a security element according to an embodiment of the invention, FIG. 3 shows the visual impression of a security element according to the invention under various viewing conditions, in (a) when it is viewed perpendicularly and unaided, in (b) when it is viewed at an angle and with the unaided eye, and in (c) when viewed perpendicularly through a circular polarizer placed on top of it, FIG. 4 shows another embodiment of the security element according to the invention, in which the phase delay layer is arranged underneath the semitransparent ink layer, FIG. 5 shows a further embodiment of the security element according to the invention, in which the phase delay layer and the semitransparent ink layer are applied to the thin film element, and FIG. 6 shows yet another embodiment of the security element according to the invention, in which color-constant zones, color-shifting zones, and the concealed security feature of the phase delay layer are combined with an embossed hologram.

The invention will now be described using the example of a banknote. For this purpose, FIG. 1 shows a schematic representation of a banknote 10 having a security element 12 according to the invention in the form of an adhesively attached transfer element. Of course, the invention is not limited to transfer elements and banknotes, but may be used for all types of security elements, for example for labels on goods and packages, or for the protection of documents, identity cards, passports, credit cards, health cards and the like. On banknotes and similar documents security threads for example may be used as well as transfer elements, and besides top view elements, also see-through elements.

The structure of a security element 12 according to the invention will now be explained in greater detail with reference to FIGS. 2 and 3, wherein FIG. 2 shows a cross-section through the security element and FIG. 3 shows the visual impression of the security element when viewed from three different directions, represented schematically in (a) to (c). FIG. 3(*a*) shows a section of the security element 12 when viewed perpendicularly and with the unaided eye, FIG. 3(*b*) shows the section of (a) when viewed at an angle, also with the unaided eye, and FIG. 3(*c*) shows the section of (a) and (b) as it is seen when viewed perpendicularly through a circular polarizer placed on top of it.

With reference first to FIG. 2, security element 12 includes a thin film element 22 having a color shift effect, which is applied to a carrier film 20. Thin film element 22 includes a reflection layer 24 formed of an opaque aluminum layer, a dielectric $SiO_2$ spacer layer 26 that has been vapor deposited on reflective layer 24, and a semitransparent absorber layer 28, which may be formed of chrome, for example. As was explained earlier, the color shift effect of such a thin film element 22 is based on interference effects caused by interference of the light beams reflected on sublayers 24, 26, 28 of the element.

In first zones 30 a semitransparent ink layer 34 is printed onto thin film element 22, in the zones 32 outside of first zones 30, there is no ink layer printed on thin film element 22. Thin film element 22 and semitransparent ink layer 34 are harmonized in such manner that they create essentially the same color impression when viewed perpendicularly.

When security element 12 is tilted, the color impression of thin film element 22 changes in uncovered zones 32, while the color impression in the covered, first zones 30 remains almost unchanged. For example, thin film element 22 may be designed such that its color impression changes from magenta when viewed perpendicularly to green when viewed at an angle. In harmony with this, semitransparent ink layer 34 also presents a magenta-colored impression when viewed perpendicularly, which however does not change significantly when security element 12 is tilted.

As represented in FIG. 3(*a*) by the similarly hatched areas, covered zones 30 and uncovered zones 32 thus present a very similar or even identical color impression when viewed perpendicularly. The semitransparency of ink layer 34 helps to render the color impressions of the two zones even more similar. Whereas the chromaticity of a printed color layer may be determined very precisely and reproducibly, the shift color displayed by thin film element 22 when viewed perpendicularly varies slightly from one security element to another due to production tolerances.

Because of the semitransparent formation of ink layer 34, part of this perpendicular shift color shows through ink layer 34 and contributes to the overall color impression of the security element in first zones 30. If the perpendicular shift color of thin film element 22 in uncovered zones 32 varies slightly, the color impression in the covered zones 30 therefore changes accordingly, and the overall color impressions in zones 30, 32 become more alike. In addition, the semitransparency of printed ink layer 34, also lends a visual impression of a metallic sheen in covered zones 30, since there the metallic sheen of the underlying reflection layer 24 shows through. Covered zones 30 and uncovered zones 32, which have a metallic sheen anyway because thin film element 22 is directly visible there, therefore have a very similar appearance in terms of their metallic sheen properties as well.

When security element 12 is tilted, the visible color impression of thin film element 22 changes progressively from magenta to green in uncovered zones 32 as the tilt angle is increased, whereas the color impression in first zones 30, that are covered with ink layer 34, remains essentially unchanged. From an inclined viewing angle as shown in FIG. 3(*b*), the viewer thus sees a marked color difference between zones 30 and 32, as is indicated in the figure by the different hatched areas. This combination of color-variable zones 32 with directly adjacent color-constant zones 30 further enhances the visual perception of the color shift effect, since the human eye responds more intensely to the color differences it perceives than to the change in color itself.

In addition to the evident security feature provided by the color-variable and color-constant zones 30, 32, security element 12 also contains a concealed security feature, provided by a transparent phase delay layer 36, which is disposed on top of thin film element 22 in the form of a pattern in second zones 38.

Phase delay layer 36 consists of a birefringent material, for example a nematic liquid crystal material. The layer thickness of phase delay layer 36 is typically selected such that its phase delay corresponds to an optical retardation between about $\lambda/6$ and about $\lambda/2$, preferably about $\lambda/4$, wherein $\lambda$ represents a wavelength in the range of the visible spectrum.

When security element 12 is viewed with normal, unpolarized light and without auxiliary means, second zones 38 with phase delay layer 36 are practically imperceptible because the phase delay of layer 36 has the same effect for all polarization directions of the incident light, and its light absorption is insignificant.

But if security element 12 is instead viewed with a polarizer 40 placed on top of it, as shown in FIG. 3(*c*), large contrast differences between zones 38, 39 with and without phase delay layer 36 become clearly visible. The presence and shape of the pattern formed by zones 38 may thus be used as a further authentication measure, for example at the point of sale or in banks.

The mode of operation of the concealed security feature will now be explained using the example of a $\lambda/4$ phase delay layer 36 and a circular polarizer 40 that transmits only right-circular polarized light. Under these conditions, only the right-circular polarized component of incident unpolarized light is passed by circular polarizer 40. In subzones 39 of the security element where phase delay layer 36 is not present, the right-circular polarized light is reflected by metallic reflection layer 24 of thin film element 22 with an opposite polarization direction, that is to say it is reflected as left-circular polarized light. The reflected left-circular polarized light is blocked by circular polarizer 40, and so subzones 39 appear dark to the viewer.

On the other hand, in subzones 38 with the phase delay layer, the right-circular polarized light is converted into linearly polarized light by phase delay layer 36 before it is reflected on reflection layer 24. The unchanged linearly polarized light passes through phase delay layer 36 again and is converted to right-circular polarized light, which passes under the selected conditions the circular polarizer 40 unobstructed. In subzones 38, the pattern 30, 32 of the open security feature appears thus with essentially unaltered brightness to the viewer.

When a linear polarizer is placed on the element instead of a circular polarizer, reverse contrast conditions are created when the linear polarizer is oriented appropriately: In this case, in the subzones 39 without a phase delay layer 36, the linearly polarized light is reflected by reflection layer 24 of thin film element 22 with unchanged linear polarization, such that the reflected light passes through the linear polarizer. Pattern 30, 32 of the open security feature is thus visible with unaltered brightness in subzones 39. On the other hand, subzones 38 with phase delay layer appear now dark, because the linearly polarized light is converted to circular polarized light by phased delay layer 36, the circularly polarized light is reflected by the reflection layer with the opposite circular polarization direction, and is converted to linear polarized light, whose polarization vector is perpendicular to the initial polarization, when it passes through the phase delay layer again, such that the reflected light is blocked by the linear polarizer.

In this context, the ability to combine the two security features depends to a large degree on the fact that semitransparent ink layer 34 essentially preserves the polarization state of the light that passes through it. This ensures that the pattern created by phase delay layer 36 may be rendered equally visible in both the color-variable and the color-constant zones 30, 32.

In order to produce the security element 12 of FIG. 2, thin film element 22 and semitransparent ink layer 34 may, for example, be applied to a first carrier foil, and phase delay layer 36 may be applied to a second carrier foil in the desired pattern. The second carrier foil is then transferred together with phase delay layer 36 to the thin film element 22 with the semitransparent ink layer 34 using laminating adhesive 42, and the second carrier foil is then peeled off.

A further embodiment of the invention is shown in FIG. 4. Unlike the configuration of FIG. 2, in this embodiment phase delay layer 36 is positioned below semitransparent ink layer 34. The layer indicated with reference number 44 represents a transparent layer, for example an adhesive layer, a protective coating layer, a primer, or similar. In addition, semitransparent ink layer 34 is covered with a protective coating layer 46.

Since the semitransparent ink layer 34 largely preserves the polarization state of the light passing through it, the mode of operation of the embodiment of FIG. 4 is the same as that described previously. In addition, gaps 50 are introduced in reflection layer 24 of the thin film element, forming a negative text, for example. In the area of these gaps 50, thin film element 22 is transparent or translucent, thereby creating a striking contrast effect in transmitted light, in addition to the effects already described. In this context, the term translucence is used to refer to a certain degree of light transmissivity, wherein translucent layers usually reduce the brightness of the objects located behind or below them and/or alter their color.

Absorber layer 28 may also be provided with gaps 52. In the area of gaps 52 in the absorber layer, thin film element 22 has no color shift effect because there is no interference. If the gaps 52 are located in zones 32 that are not covered by the ink layer, as shown in FIG. 4, security element 12 takes on the metallic sheen of reflection layer 24 there. Of course, the embodiment of FIGS. 2 and 3 described above may also be provided with such gaps in the reflection layer and/or the absorber layer.

In the alternative embodiment of FIG. 5, first the phase delay layer 36 is printed on thin film element 22, and this is followed by semitransparent ink layer 34. As for the embodiments of FIGS. 2 and 4, here too the ink layer 34 may completely cover phase delay layer 36, as shown in the left part of the figure, the ink layer may lie entirely inside the phase delaying zones, as shown in the middle part of the figure, or the ink layer may partly overlap phase delay layer 36, as shown in the right part of the figure. Since semitransparent ink layer 34 largely preserves the polarization state of the light passing through it, the desired polarization effect may be used for authentication in all cases.

FIG. 6 shows a color shift hologram as a further embodiment of the invention, in which the effects described previously are combined with an embossed hologram. Security element 60 of FIG. 6 includes a carrier foil 62 and a UV lacquer layer 64 that has been applied on top of carrier foil 62, embossed and cured. The embossing structures of coating 64 form a diffractive relief structure in the form of a hologram, a hologram grating image or a hologram-like diffraction structure. In other embodiments, the embossing structures may also be achromatic relief structures with an uncolored, for example silvery matt appearance A thin film element 66 including, as described above, for example, a reflection layer 68, a dielectric spacer layer 70, and a semitransparent absorber layer 72 is applied to the relief structure of lacquer layer 64. The reflection layer and the absorber layer may both be provided with gaps, 74 and 76.

In similar manner to the process described earlier, by printing on a semitransparent ink layer 80 in zones it is possible to create harmonized color-variable and color-constant zones that, together with the holographic relief structure, form the open security feature. A transparent phase delay layer 82 in the form of characters, a pattern or a code is then transferred onto this layer sequence, to obtain a concealed security feature that may be revealed using a linear or circular polarizer.

Color shift hologram 60 offers the viewer an attractive appearance with high recognition value. When viewed perpendicularly, the security element displays a colored, for example magenta-colored hologram as the basic structure. When the security element is tilted, the zones of the hologram that are not covered with semitransparent ink layer 80 change color, so that their color impression shifts from magenta to green, for example, while the color impression of the hologram in covered subzones 80 remains essentially constant.

In the zones in which gap areas 74 of the absorber layer are located in zones not covered by an ink layer, the visual impression of the security element is determined by reflection layer 68, and the hologram appears silvery and metallic in those areas. In zones 76 without a reflection layer, the security element appears transparent or translucent. Gap areas 74, 76 may thus create a metallic negative text, for example, within the security element, or local transparent zones in a security element that is otherwise opaque. The concealed security feature of phase delay layer 82 may also be used for more thorough authentication procedures, as described previously.

In all described forms, the semitransparent ink layer may also include a plurality of subzones with different color impressions. The color impression of the thin film element may then be adapted to match the color impression of one or more subzones for one or even several predefined viewing conditions. For example, a thin film element for which the color impression changes from magenta to green when it is tilted may be combined with a semitransparent ink layer having two subzones, of which the first subzone appears magenta and the second appears green. The color impression of the thin film element then essentially matches the color impression of the first subzone of the ink layer (magenta) when viewed perpendicularly, but when it is tilted, it essentially matches the color impression of the second subzone of the ink layer (green). This color change and the associated change in visual assignment may thus serve to make various design elements in the security element appear and/or disappear when the security element is tilted.

In all embodiments, the thin film elements may be created also in the form absorber layer/dielectric layer/absorber layer, and even larger layer stacks are possible with the sequence absorber layer 1/dielectric layer 1/absorber layer 2/dielectric layer 2 . . . dielectric layer N−1/absorber layer N, where N=3, 4, 5 . . . Layer sequences of such kind have a color shift effect too, but they are not opaque so the effect may also be viewed from the back of the security element. Security elements including thin film elements of such kind may particularly be used with documents that have see-through areas.

The gaps in the reflection layers described above may also be arranged in a grid pattern, preferably occupying a low proportion of the surface, 40% or less. The gaps in the reflection layers are then practically unnoticeable in incident light, but appear clearly in transmitted light.

The invention claimed is:

1. A security element for securing value objects, comprising a thin film element having a color shift effect, a semitransparent ink layer, which is disposed on top of the thin film element in first zones, wherein the semitransparent ink layer includes a plurality of subzones with different color impressions, and the color impression of the thin film element is coordinated with the color impression of at least one of the subzones when viewed under predefined viewing conditions, and a transparent phase delay layer, which is disposed on top of the thin film element in second zones, and which forms a phase-shifting layer for light in the visible wavelength range;

wherein the semitransparent ink layer essentially preserves the polarization state of light in the visible wavelength range passing through it.

2. The security element as recited in claim 1, characterized in that the semitransparent ink layer has a light transmissivity between 30% and 95% in a spectral range in which the color impression of the thin film element is coordinated with the color impression of the semitransparent layer.

3. The security element as recited in claim 1, characterized in that the semitransparent ink layer is imprinted.

4. The security element as recited in claim 1, characterized in that the semitransparent ink layer is present in the form of characters, patterns or codes.

5. The security element as recited in claim 1, characterized in that when the security element is viewed perpendicularly, the color impression of the thin film element outside the first subzones essentially matches the color impression of at least one subzone of the semitransparent ink layer.

6. The security element as recited in claim 1, characterized in that the thin film element includes a reflection layer, an absorber layer and a dielectric spacer layer interposed between the reflection layer and the absorber layer.

7. The security element as recited in claim 6, characterized in that the reflection layer is formed by an opaque or semitransparent metallic layer.

8. The security element as recited in claim 7, wherein the opaque or semitransparent metallic layer comprises an aluminum layer.

9. The security element as recited in claim 6, characterized in that the dielectric spacer layer is formed by an evaporation deposited film created in a vacuum vapor deposition process, a printed layer, or an ultrathin foil, particularly a stretched polyester foil.

10. The security element as recited in claim 6, characterized in that the reflection layer has gaps in the form of patterns, characters or codes, which form transparent or translucent zones in the thin film element.

11. The security element as recited in claim 6, characterized in that the absorbers layer and/or the spacer layer has gaps in the form of patterns, characters or codes, in which no color shift effect is perceptible.

12. The security element as recited in claim 1, characterized in that the thin film element includes at least one first absorber layer, a second absorber layer, and a dielectric spacer layer arranged between the two absorber layers.

13. The security element as recited in claim 1, characterized in that the security element further has a relief structure on which the thin film element is disposed in an overlap area.

14. The security element as recited in claim 13, characterized in that the relief structure forms a diffractive structure, such as a hologram, a holographic grating image, or a hologram-like diffraction structure, or an achromatic structure such as a matte structure, a micromirror array, a blazed grating with a sawtooth-like notched profile or a Fresnel lens arrangement.

15. The security element as recited in claim 1, characterized in that the phase delay of the phase delay layer corresponds to an optical retardation between $\lambda/6$ and $\lambda/2$ for light in the visible wavelength range.

16. The security element as recited in claim 1, characterized in that the phase delay layer forms a $\lambda/4$- layer for light in the visible wavelength range at least in subzones.

17. The security element as recited in claim 1, characterized in that the phase delay layer is formed from nematic liquid crystal material.

18. The security element as recited in claim 1, characterized in that the phase delay layer is present in the form of patterns, characters or a code.

19. The security element as recited in claim 1, characterized in that the security element has a substrate on which the thin film element, the semitransparent ink layer, and the phase delay layer are arranged.

20. The security element as recited in claim 19, characterized in that the substrate is formed by a plastic foil.

21. The security element as recited in claim 1, characterized in that the security element is a security thread, a security tape, a security strip, a patch or a label that may be attached to a security paper, value document or the like.

22. A method for manufacturing a security element comprising the security element of claim 1, comprising the steps in which in first zones, a semitransparent ink layer is disposed on top of a thin film element having a color shift effect, wherein the color impression of the thin film element is coordinated with the color impression of at least one subzone of the semitransparent ink layer when viewed under predefined viewing conditions, a transparent phase delay layer is disposed in second zones on top of the thin film element, which forms a phase-shifting layer for light in the visible wavelength range, and the phase delay layer is applied to a carrier foil and is transferred to the thin film element with the semitransparent ink layer.

23. The method as recited in claim 22, characterized in that the semitransparent ink layer is imprinted.

24. The method as recited in claim 22, characterized in that the phase delay layer is printed onto the thin film element and, if applicable, onto the ink layer.

25. The method as recited in claim 22, characterized in that an embossing lacquer layer is applied to a substrate and embossed in the form of a desired relief structure, and that the thin film element is applied on top of the relief structure in an overlap area.

26. The method as recited in claim 22, characterized in that the reflection layer of the thin film element and/or the absorber layer of the thin film element are provided with gaps in the form of patterns, characters or codes.

27. The method as recited in claim 22, wherein the semitransparent ink layer is imprinted in a silkscreen, intaglio or flexographic printing process.

28. A security paper for manufacturing security or value documents comprising the security element in accordance with claim 1.

29. The security paper as recited in claim 28, characterized in that the security paper includes a carrier substrate made from paper or plastic.

30. A data carrier, having the security element as recited in claim 1.

* * * * *